United States Patent [19]

Takahashi

[11] Patent Number: 4,831,984

[45] Date of Patent: May 23, 1989

[54] CENTRIFUGAL GOVERNOR FOR INJECTION TYPE INTERNAL COMBUSTION ENGINE

[75] Inventor: Masaatsu Takahashi, Saitama, Japan

[73] Assignee: Disel Kiki Co., Ltd., Tokyo, Japan

[21] Appl. No.: 244,130

[22] Filed: Sep. 14, 1988

[30] Foreign Application Priority Data

Sep. 18, 1987 [JP] Japan ..... 62-232384

[51] Int. Cl.[4] ..... F02M 39/00

[52] U.S. Cl. ..... 123/373; 123/365

[58] Field of Search ..... 123/373, 324, 364, 365, 123/179 L

[56] References Cited

U.S. PATENT DOCUMENTS

| | | | |
|---|---|---|---|
| 2,588,119 | 3/1952 | Hurst | 123/374 |
| 3,572,303 | 3/1971 | Becker | 123/365 |
| 3,620,199 | 11/1971 | Kuhn | 123/374 |
| 3,842,815 | 10/1974 | Bechstein | 123/373 |
| 3,895,619 | 7/1975 | Potter | 123/374 |
| 4,164,924 | 8/1979 | Makino | 123/374 |
| 4,286,558 | 9/1981 | Djordjevic | 123/373 |
| 4,604,977 | 8/1986 | Ohinishi | 123/373 |
| 4,612,890 | 9/1986 | Ohnishi | 123/373 |
| 4,656,980 | 4/1987 | Ohnishi | 123/373 |
| 4,754,734 | 7/1988 | Ohkoshi | 123/374 |

*Primary Examiner*—Carl Stuart Miller

*Attorney, Agent, or Firm*—Henry C. Nields

[57] ABSTRACT

According to the present invention, there is provided a centrifugal governor for an injection type internal combustion engine, particularly an all speed governor for a small fuel injection pump which is accomodatable in a housing a cam shaft extends through. A flyweight is disposed at an end of the cam shaft so as to produce propulsion power backward, and the movement of the flyweight causes the tension lever, which has a point of support at its center, to rotate, thereby pressing a governor spring assembly of a concentric, multi-core spring which exerts no load on elements that support the spring assembly. The displacement of the flyweight causes via the tension lever the torque cam to rotate. A guide lever and a floating lever are rotatably supported at the lower end of the tension lever, and the opposite end of the guide lever is united with the floating lever by a cancellation spring. A speed lever is engaged with an intermediate guide of the guide lever at the tip thereof, and the floating lever is engaged with a control member via a linkage at one end thereof. Furthermore, one end of a sensor lever which includes an adjustable intermediate shaft is contacted with the torque cam while the other end thereof is engaged with the linkage.

6 Claims, 3 Drawing Sheets

CENTRIFUGAL GOVERNOR FOR INJECTION TYPE INTERNAL COMBUSTION ENGINE

FIELD OF THE INVENTION

The present invention relates to a centrifugal governor for an injection type internal combustion engine, more particularly it is concerned with a centrifugal governor suited for an injection type internal combustion engine of small size.

BACKGROUND OF THE INVENTION

In an injection type internal combustion engine, represented by a diesel engine, it is necessary to operate a fuel injection pump in a manner such that it may maintain certain relationship between fuel injection quantity and rotating speed of the engine.

A governor is employed for this purpose, and a mechanical governor is utilized in many cases. Function of the governor is to actuate a control rack or a control rod by driving force of a flyweight produced in accordance with engine rotating speed, thereby rotating a plunger of the fuel injection pump to change an effective stroke thereof.

When the fuel injection pump is a relatively large one, a cam shaft actuating the fuel pump plunger is arranged to penetrate a pump housing in the longitudinal direction thereof. Thus, in this case, the governor assembly may be mounted onto a side face of the fuel injection pump housing as a part thereof, so that it is easy to allow the governor to have control function for entire the speed range since there is no limitation in terms of space therefor.

In case of a compact car, however, the engine is small, and therefore the fuel injection pump employed therefor is small, so that severe limitation is imposed on the installation space. In this case, since the cam shaft can not be provided to penetrate the pump housing, it is typical to let the fuel injection pump, as an individual element, engage with the cam shaft through an opening formed at an upper portion of the casing which rotatably supports the cam shaft, as disclosed in Japanese Patent Application Laid Open Publication No. 156925/1979.

In this case therefore, the governor itself has to be small. On the other hand, in order to freely adjust the amount of fuel injection quantity for adjustable speed and entire load conditions, enlarging of the mechanism is unavoidable.

Thereupon, the governor of this type has to have simple structure i. e., the fuel injection quantity is controlled by the balance between the governor lever and the governor spring, and governors which are not capable for speed adjustment for entire speed range from low speed to the maximum speed and for arbitrary adjustment of fuel injection for entire load conditions.

SUMMARY OF THE INVENTION

The present invention is developed to eliminate the aforementioned difficulties, and for its purpose it provides a centrifugal governor suited for a compact car, which is capable of controlling speed for all speed conditions ranging from low speed to a maximum speed, determining a full load injection an a starting injection, with a very compact construction over all so as to be accommodated together with a fuel injection pump in a casing attached to a cylinder block.

In order to attain this purpose, according to the present invention, a governor located in a housing, in which a cam shaft is rotatably supported at its lower section and an fuel injection pump is disposed above the cam shaft, is characterized in that it comprises:

I. a flyweight disposed at an end of the cam shaft so as to be displaced in accordance with a rotational speed of the engine:

II. A tension lever rotatable upon a driving force of the flyweight with an intermediate fixed shaft as a pivot;

III. a governor spring assembly supported so as not to exert any supporting load between a housing side spring seat and another spring seat provided to said tension lever, and so as to be compressed upon rotation of the tension lever:

IV. a guide lever and a floating lever, both rotatable with a pin provided at a lower end of the tension lever as a pivot, and normally connected to each other as an integrated element by a cancellation spring around the pin;

V. a speed lever shaped like a bell crank, rotatably supported at one end with a shaft connecting the control lever as a fulcrum, and engaged with an intermediate guide of said guide lever at the other end;

VI. a link connected to the upper end of said floating lever at one end, and connected a control member of the fuel injection pump at the other end;

VII. a torque cam having a curved cam plate at a lower portion, supported by a fixed shaft at an intermediate portion, and having an operation lever element actuated by a torque cam rod extending from the tension lever at a upper portion:

VIII. a sensor lever located opposite to said torque cam, supported by a adjustable shaft at an intermediate portion, including a claw contacting with the torque cam at an upper portion, and engaged with said link at a lower portion.

According to the above construction, realized are arbitrary adjustments of speed for the entire speed range from low seed to maximum speed, and full load fuel injection, as well as starting fuel injection. Moreover, the mechanism for such adjustments requires only small space.

In the conventional all-speed governor, the tension lever is disposed at the forward end of the cam shaft, the flyweight is at an intermediate point relatively close to the cam, the idle spring assembly is at the back side of the tension lever. Therefore, large space is required along the axial direction of the cam shaft.

In the governor of this invention, however, the flyweight is disposed at the forward end of the cam shaft, the tension lever is located midway on the cam shaft, and the idle spring assembly is provided above the cam shaft. Accordingly, only small space is required along the axial direction of the cam shaft.

Also, in the conventional governor, the guide lever extends considerably long above the tension lever, with the horizontal floating lever being connected to the upper end thereof via a joint ball. And, the control lever assembly is mounted on at an intermediate point of the floating lever. Hence, large space is also required in the height direction of the cam shaft.

In the present invention, on the contrary, the guide lever and the floating lever are disposed parallel to each other, both fixed to the lower end of the tension lever by a pin. And, the bell crank like speed lever is disposed beneath the governor spring assembly. Thus, large space is not required in the height direction, either.

As for the governor of the present invention, as appreciated from the aforementioned description, it is possible to adjust speed in a preferable manner at the maximum and minimum speed as well as therebetween while only small housing is necessary for accommodation therefor, so that such a housing or governor may be suitably accommodated in small space for the cylinder block of a compact car.

Furthermore, since a control member of the fuel injection pump (the control rack or the control rod) is connected with the floating lever by the linkage as an assembly, an engagement with the fuel injection pump is easy.

Other features of the present invention will be described in the following embodiment.

DETAILED DESCRIPTION

Now, an embodiment of the present invention will be described with reference to the accompanying drawings.

Figure 1:
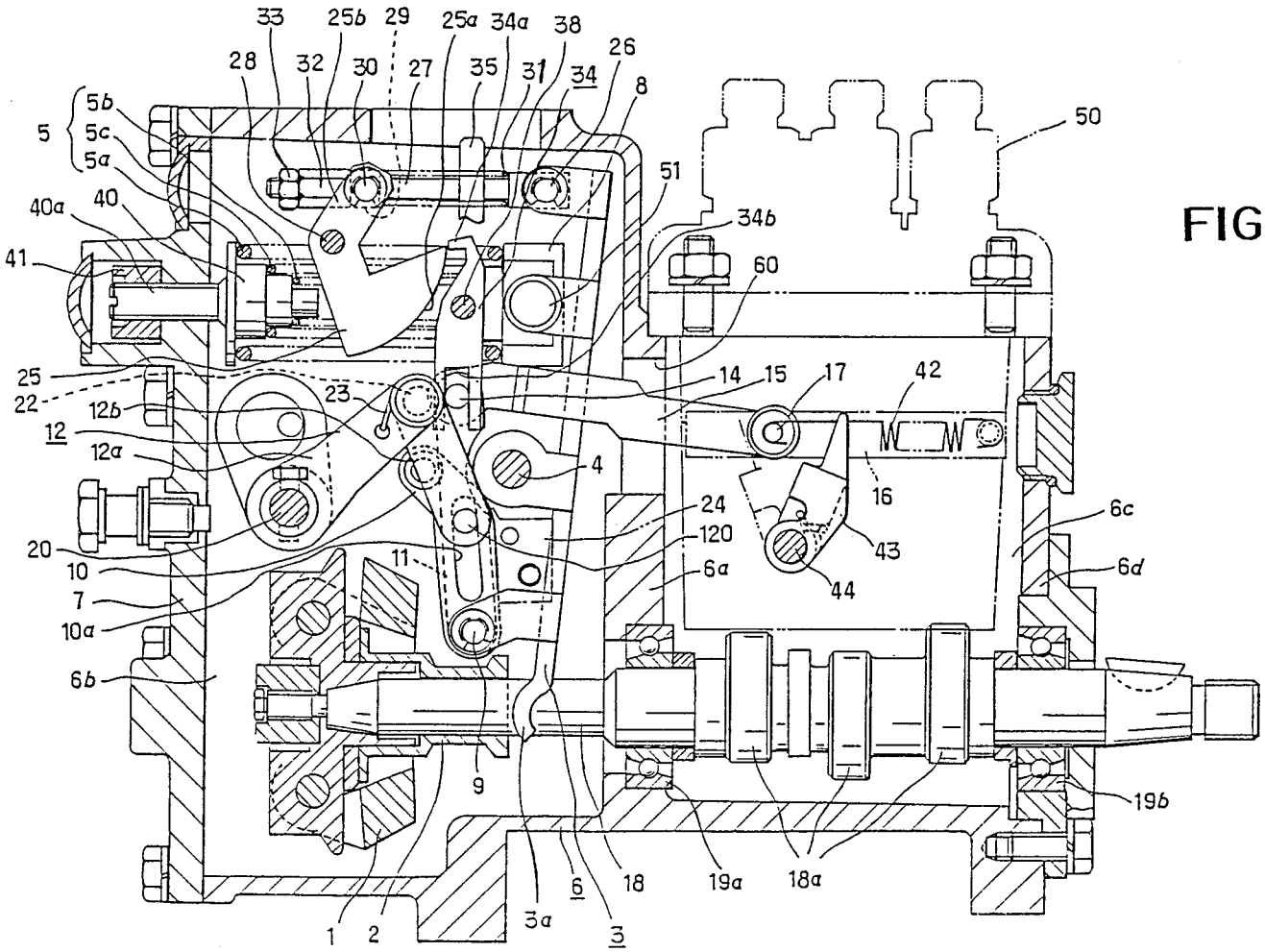
FIG. 1 is a longitudinal, sectional, side view, showing an embodiment of a centrifugal governor for an injection type engine according to the present invention.
Figure 2:
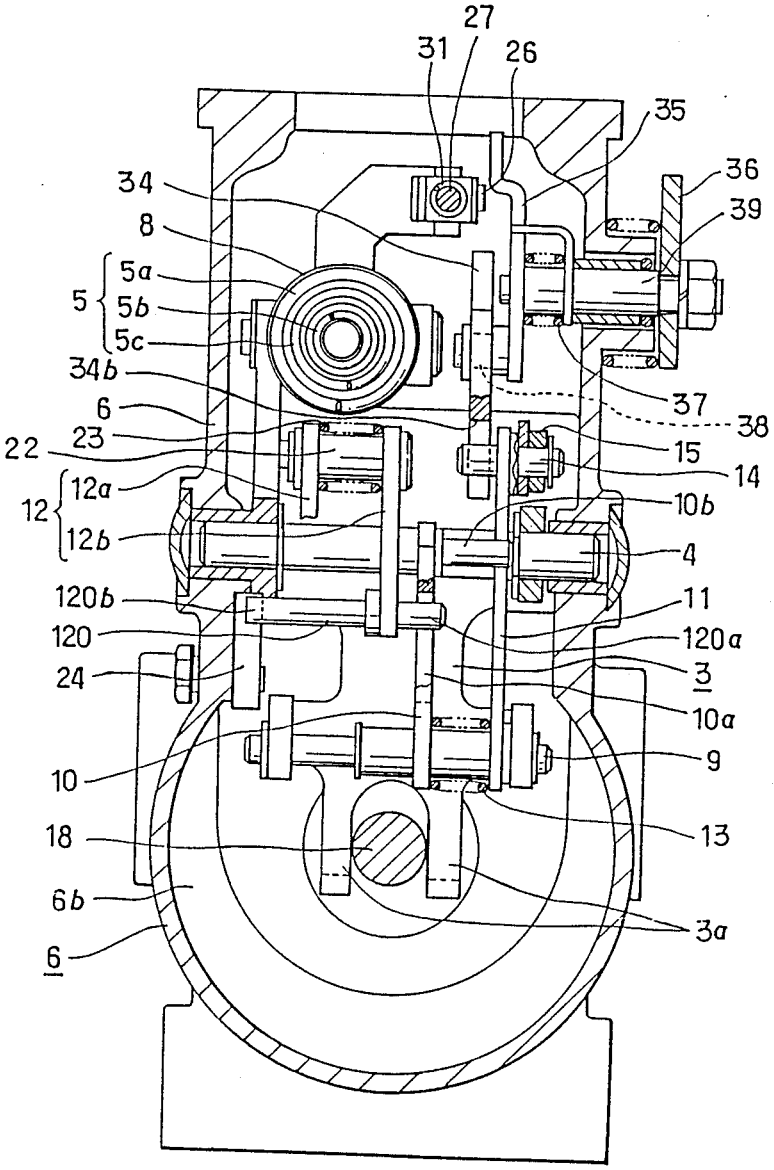
FIG. 2 is a longitudinal sectional, back view of the same.

In FIGS. 1 and 2, reference numeral 6 designates a housing made by means of casting, being provided with a partition wall 6*a* at center thereof so as to define a governor chamber 6*b* and a pump room 6*c*, with an opening at the end of the governor chamber 6*b* being closed by a cover 7.

A cam shaft 18 is rotatably supported by bearings 19*a* and 19*b* disposed near lower portion of a wall 6*d* which faces said partition wall 6*a*. Said cam shaft 18 protrudes from the wall 6*d* at one end, so as to be connected with a main shaft of an engine via a gear which is not illustrated. In the pump room 6*c* a fuel injection pump of in-line type 50 is inserted, and a plunger, which is not shown, of said fuel injection pump 50 is reciprocated by a plurality of cams 18*a* formed on the cam shaft 18. The other end of said cam shaft 18 extends into the governor chamber 6*b*, and a flyweight 1 is mounted on that end of the cam shaft 18. The flyweight 1 faces the partition wall 6*a* at its propulsion force side, and therefore the propulsion force is generated for backward movement. The flyweight 1, same as the well known type, extends and closes with pins as points of support so that a sleeve 2 is pushed in the axial direction when it extends outward.

Numeral 3 denotes a tension lever, which is disposed vertically near the partition wall 6*a* and has a forked portion 3*a* that contacts with the sleeve 2 at the lowermost portion. The midpoint of the tension lever 3 is tiltably supported by an intermediate shaft 4 supported in the width direction of the governor chamber 6*b*. At an upper portion of the tension lever 3 a spring seat 8 is attached by a pin 51, and another spring eat 40, a counter part of the spring seat 8, is provided to a cover 7 opposite to the spring seat 8.

The spring seat 40 includes at a rear portion a threaded shaft 40*a* penetrating the cover 7, so that it can move forward and backward by a lock nut 41. Between said two spring seats 8 and 40, supported is a governor spring assembly 5 which balances with the centrifugal force of the flyweight 1 for the entire speed range so as to determine the position of the tension lever 3 relative to the flyweight. The governor spring assembly 5 includes concentric two members, i. e., a governor spring 5*a* and an idle spring 5*b*, both exerting no load on the member which supports the themselves. And, an auxiliary spring 5*c* is also concentrically provided for smoother movement if required.

Numeral 10 designates a guide lever, which has a sectional view similar to the bell crank, provided with a portion 10*b* extending laterally at its upper end and tiltable supported by a pin 9 lying at the lower portion of the tension lever 3 at its lower end. An intermediate guide 10*a* in the form slot is formed at the central area of the guide lever 10.

Figure 3:
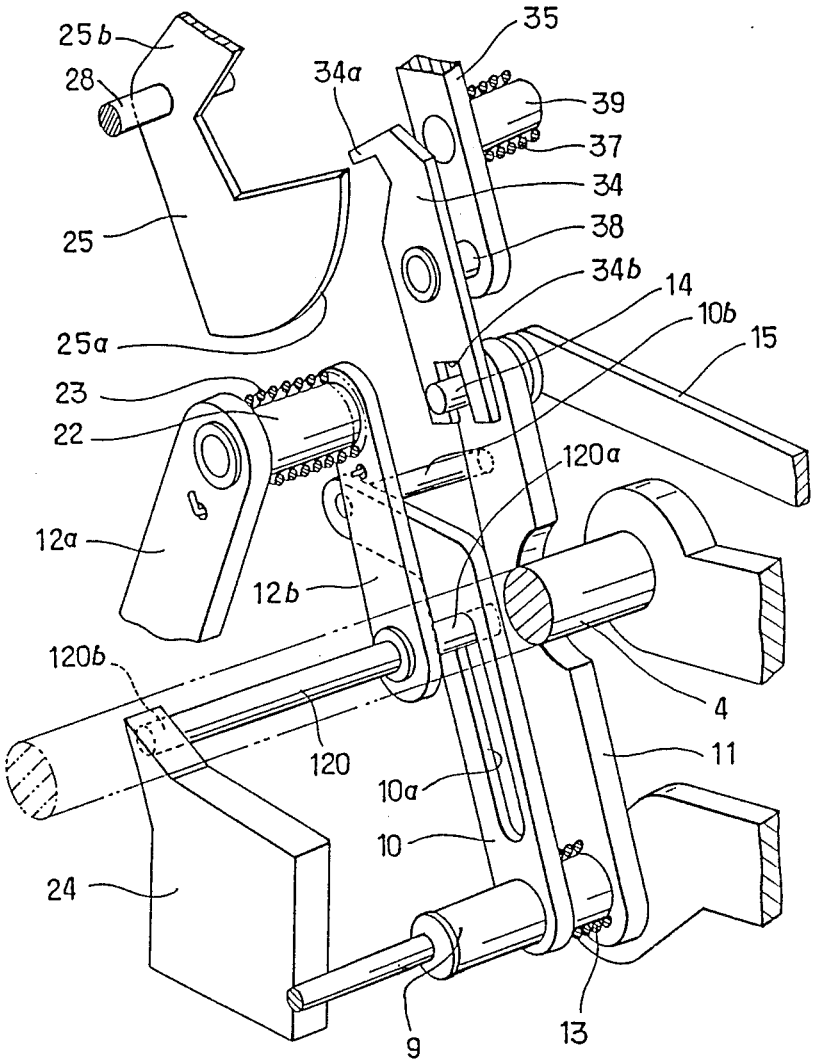
FIG. 3 is a perspective view, showing an installation of lever members of the present invention.

Numeral 11 designates a floating lever, and, as shown in FIGS. 2 and 3, it is disposed parallel to said guide lever 10 with its lowermost portion being tiltably supported by said pin 9. Said extending portion 10*a* of the guide lever 10 is forced to contact with the intermediate side portion of the floating lever 11 by the spring force of a cancellation spring 13 provided around the pin 9, so that said guide lever 10 and the floating lever 11 may be constructed as a single element for normal operation.

The other end of the floating lever 11 is connected to a linkage 15 via a pin 14. The linkage 15 extends into the pump room 6*c* through an opening 60 bored in the partition wall 6*a*, so as to be connected to a control rack 16 via a rack pin 17. A start spring 42 is provided to the rack pin 17 so as to always bias the control rack 16 to a direction for fuel increase.

Reference numeral 12 designates a speed lever which comprises two members, namely a first lever 12*a* and a second lever 12*b* with the upper ends of both being supported by a connection pin 22, and which is shaped like a bell crank. The first lever 12*a* is integrated with as speed control lever from an acceleration pedal, which is not shown, and its lower end is rotatable with the shaft 20 as a fulcrum. At the free end (lower end) of the second lever 12*b*, a head pin 120 which extends perpendicularly to the second lever is disposed as shown in FIG. 3, with one end 120*a* of the head pin 120 being engaged within the intermediate guide 10*a* of said guide lever 10.

Around said connection pin 22 there is provided the cancellation spring 23 which affects on the first lever 12*a* and the second lever 12*b*, whereby the other end 120*b* of said head pin 120 is spring-forced to a guide plate 24 fixed to a lateral side wall of the housing 6 by bolts.

Indicated by reference numeral 25 is a torque cam which has a cam plate 25*a* of predetermined curvature for full load injection. This torque cam 25 is located t a lateral side of said governor spring assembly 5 so as to be rotatable with the fixed shaft 28 extending in the width, direction of the housing as a shaft of support.

Furthermore, a torque cam rod 27 is connected to the uppermost portion of said tension lever 3 via a pin 26. The torque cam rod 27 extends parallel to the governor spring assembly 5, with a slide block 29 being slidably disposed therearound. An actuation lever portion 25*b* which extends from the torque cam is connected to the slide block 29 via a pin 30. An adjusting nut 32, which is stopped by a locking nut 33, is screwed at the end of the torque cam rod 27, so as to adjust the distance between said pins 26 and 30. The slide block 29 is always biased toward the adjusting nut by the cancellation spring 31 disposed between the adjusting nut 32 and the head of the torque cam rod 27.

Indicated by reference numeral 34 is a sensor lever which moves with said torque cam 25. The sensor lever 34 is located at a position extending vertically and facing the torque cam 25, with its intermediate portion being supported by a pin 38. The sensor lever 34 includes a claw portion 34*a* facing the cam plate 25, of the torque cam 25 at the upper end thereof and a guide slot 34*b* of a fork shape at the lower end. A pin 14 which connecting said link 15 and the floating lever 11 is engaged with said guide slot 34*b*.

Reference numeral 35 designates a full load lever, of which central portion is connected to a shaft 39 penetrating the lateral wall of the housing 6, and on which the cancellation spring 37 exerts force, so that it may be united with the full load setting lever 36 that moves with the shaft 39, as depicted in FIG. 2. A support pin 38 is provided at the lower end of the full load setting lever 35, by which pin 38 said sensor lever 34 can change the rotational angle.

Reference numeral 43 designates a stop lever, and as illustrated in FIG. 1, it is rotatable with a shaft 44 as a pivot and extends inward from the inner side wall of the pump room 6*c* with one end being contactable with said rack pin 17 when the engine stops.

OPERATION

Operation of the governor of the present invention now will be described.

When the engine is not operating, the flyweight 1 is closed, and the governor spring 5*a* and the idle spring 5*b* do not have initial setting power, i. e., they extend respective free lengths In this state, when the acceleration pedal is pressed, the first lever 12*a* united with, the speed control lever starts rotating with the shaft 20 as a pivot. Since the second lever 12*b* is engaged with the guide lever 10 via one end 120*a* of the head pin 120 and the intermediate guide 10*a*, the guide lever 10 rotates with the pin 9 as a shaft of support. The guide lever 10 is united with the floating lever 11 by the cancellation spring 13, and therefore the floating lever 11 also rotates upon pushingness of the protruding piece 10*b*. Hence, the linkage 15 connected to the floating lever 11 via the pin 14 is moved in the axial direction, and the control member 16 is moved toward the fuel increase side. At this time, since the sensor lever 34 rotates because of the pin 14 with the support pin 38 as a pivot, the claw 34*a* of the sensor lever 34 engages with the tip of the torque cam 25, so that the control member 16 exceeds the full load rack position and reaches the starting fuel increase position.

As the engine starts operating, the cam shaft 18 rotates and the flyweight 1 starts opening due to centrifugal force upon the rotation of the cam shaft. When the centrifugal force so generated exceeds the force of the start spring 42, the sleeve 2 is pushed to right hand in FIG. 1. Thereupon, the tension lever 3 rotates counterclockwise with the intermediate shaft 4 as a pivot. As the tension lever 3 moves, the spring seat 8 supported by the tension lever moves left, whereby first the idle spring 5*b* which is located most inward is pressed so as to generate setting power, and then the governor spring 5*a* is compressed so as to start speed adjustment as the driving force of the flyweight increases.

In other words, both the floating lever 11 and the guide lever 10, as described above, are supported by the pin 9 at the lower end of the tension lever 3, and united as a single body by the cancellation spring 13. Therefore, the floating lever 11 rotates counter-clockwise with the head pin 120, which is engaged with the intermediate guide 10*a* of the guide lever 10, as a pivot. As a result, the link 15 connected to the floating lever 11 via the pin 14 is moved left, thereby pulling the control means 16 to fuel decrease side.

On the other hand, as the rotational speed of the engine drops, the flyweight 1 is closed since the centrifugal force decreases below the force of the idle spring 5*b*. Thus, the tension lever 3 rotates clockwise, so that the control member 16 is pushed toward fuel increase side due to the opposite movement as described above, preventing the engine from stopping.

When the first lever 12*a* of the speed lever 12 is rotated clockwise in a state where the load is imposed on the engine, the second lever 12*b* connected, to the first lever 12*a* via the connection pin 22 rotates downward, so that said other end 120*b* of the head pin moves as guided by the guide plate 24 toward right hand in FIG. 1. This movement is transmitted to the guide lever 10 through the intermediate guide 10*a*. Accordingly, the floating lever 11 united with the guide lever 10 via the pin 9 rotates clockwise with the pin 9 as a center due to the change of the lever ratio. Thus, the control member 16 is moved to the fuel increment via the link 15.

The movement of said floating lever 11 is transmitted to the sensor lever 34 through the upper end pin 14 and the guide slot 34*b*, so that the sensor lever 34 inclines counterclockwise with the support pin 38 as a center. And, when the sensor lever reaches the full load rack position, the claw 34*a* formed at the end of the sensor lever 34 contacts with the torque cam 25 whereby the rack position on longer changes. At this time, since the cancellation spring 23 serves to reduce the angle between the first lever 12*a* and the second lever 12*b*, the head pin 120 of the second lever 12*b* moves away from the guide plate 24, so that the floating lever 11 does not rotate clockwise (fuel increase direction).

When the engine rotating speed increases in the above-mention state, the tension lever 3 rotates counterclockwise due to the driving force of the flyweight 1, and upon the rotation so produced the torque cam rod 27 moves against pressing force of the cancellation spring 31, so that the torque cam 25 rotates counterclockwise with the fixed shaft 28 as a pivot. As a result, the tip of the claw portion of the sensor lever 34 moves along the cam plate 25*a* of the torque cam 25. Therefore, the sensor lever 34 rotates via the support pin 38, and this rotation is transmitted to the link 15 through the guide slot 34*b* and the pin 14, moving the control member 16.

Moreover, since the support pin 38 which is a center support of the sensor lever 34 is connected to the full load lever 35, and the full load lever 35 is united with the full load setting lever 36 by the cancellation lever 37, the inclination of the sensor lever 34, or the position of the control member 16 can be adjusted by manipulating the full load setting lever 36, whereby an arbitrary control at the full load rack position is made possible.

I claim:

1. A centrifugal governor for an injection type internal combustion engine, comprising:

a housing 6 in which a cam shaft 18 is rotatably supported at its lower section and a fuel injection pump 50 is disposed above the cam shaft 18;

a flyweight 1 disposed at an end of the cam shaft 18 so as to be displaced in accordance with a rotational speed of the engine;

a tension lever 3 rotatable upon a driving force of the flyweight with an intermediate fixed shaft 4 as a pivot;

a governor spring assembly 5 supported so as not to exert any supporting load between a housing side spring seat 40 and another spring seat 8 provided to said tension lever 3, and so as to be compressed upon rotation of the tension lever 3;

a guide lever 10 and a floating lever 11, both rotatable with a pin 9 provided at a lower end of the tension lever 3 as a pivot, and normally connected to each other as an integrated element by a cancellation spring 13 surrounding the pin 9;

a speed lever 12 have a shaped like bell crank, rotatably supported at one end with a shaft 20 connecting the control lever as a pivot, and engaged with an intermediated guide 10*a* of said guide lever 10 at the other end;

a link 15 connected to the upper end of said floating lever 11 at one ed, and connected a control member 16 of the fuel injection pump at the other end;

a torque cam 25 having a curved cam plate 25*a* at a lower portion, supported by a fixed shaft 28 at an intermediate portion, and having an operation lever element 25*b* actuated by a torque cam rod 27 extending from the tension lever 3 at an upper portion;

a sensor lever 34 located opposite to said torque cam 25, supported by a adjustable shaft 38 at an intermediate portion, including a claw portion 34*a* contacting with the torque cam 25 at an upper portion, and engaged with said link at a lower portion.

2. A centrifugal governor of claim 1, wherein said flyweight 1 is attached to the tip of the cam shaft 18 in a manner such that it may produce driving force toward the backward axial direction, the tension lever 3 is disposed on the cam shaft so as to be apart from the flyweight, and the idle spring 5*b* is disposed at an upper portion of the tension lever 3 so as to be concentrical with the governor spring 5*a* as a part of a multi-core spring.

3. A centrifugal governor of claim 1, wherein said the speed lever 12 includes a first lever 12*a* rotatable with the shaft 20 as a pivot and a second lever 12*b* connected to the first lever 12*a* by a connection pin 22 at the upper end thereof, in a manner such that it may be located beneath the governor spring assembly 5 and have a curved shape like a bell crank as a whole, and at a free end of the second lever 12*b* there is provided a head pin 120 which is engaged with an intermediate guide 10*a* of the guide lever 10 at one end thereof while the other end of said head pin 120 contacts with a guide plate 24 of the housings side due to spring force of the cancellation spring 23 provided to said connection pin 22.

4. A centrifugal governor of claim wherein the entire mechanism including the flyweight 1 is disposed in a governor chamber 6*b* of the housing 6 having a partition wall 6*a* at the middle thereof, the cam shaft 18 extends penetrating the partition wall 6*a* and a, wall 6*d* of the housing, the link 15 extends penetrating the partition wall 6*a* into a pump room 6*c* so as to be connected to the control member 16 via a rack pin 17, and a starting spring 42 which biases the control member 16 to fuel increase side is provided to the rack pin 17.

5. A centrifugal governor of claim 1, wherein a torque cam rod 27 extends parallel to the governor spring assembly 5 and has a slide block 29 slidable within the limit of an adjusting nut 32 disposed at the end of the torque cam rod 27, the upper portion of the torque cam 25 is connected to the slide block 29 via the pin 30, and the slide block 29 is always biased to the adjusting nut side by the cancellation spring 31 around the torque cam rod 27.

6. A centrifugal governor of claim 1, wherein a shaft 39 extends from one of walls which define the width of the housing 6, an intermediate portion of the full load lever 25 is connected to the shaft 39, and the sensor lever 34 can change its pivot angle by a support pin 38 disposed at the lower end of the full load lever 35.

* * * * *